US007114576B2

(12) United States Patent
Keskiniva

(10) Patent No.: US 7,114,576 B2
(45) Date of Patent: Oct. 3, 2006

(54) METHOD AND ARRANGEMENT OF CONTROLLING OF PERCUSSIVE DRILLING BASED ON THE STRESS LEVEL DETERMINED FROM THE MEASURED FEED RATE

(75) Inventor: Markku Keskiniva, Tampere (FI)

(73) Assignee: Sandvik Tamrock Oy, Tampere (FI)

( * ) Notice: Subject to any disclaimer, the term of this patent is extended or adjusted under 35 U.S.C. 154(b) by 177 days.

(21) Appl. No.: 10/492,614

(22) PCT Filed: Oct. 17, 2002

(86) PCT No.: PCT/FI02/00809

§ 371 (c)(1),
(2), (4) Date: Apr. 15, 2004

(87) PCT Pub. No.: WO03/033873

PCT Pub. Date: Apr. 24, 2003

(65) Prior Publication Data

US 2004/0251049 A1 Dec. 16, 2004

(30) Foreign Application Priority Data

Oct. 18, 2001 (FI) ..... 20012022

(51) Int. Cl.
*B25D 9/26* (2006.01)

(52) U.S. Cl. ..... 173/2; 173/112; 175/25

(58) Field of Classification Search ..... 173/2, 173/4, 176, 112; 175/27, 50
See application file for complete search history.

(56) References Cited

U.S. PATENT DOCUMENTS

| | | | | |
|---|---|---|---|---|
| 4,109,475 | A * | 8/1978 | Schnell | 405/228 |
| 4,165,789 | A | 8/1979 | Rogers | |
| 4,671,366 | A | 6/1987 | Uitto et al. | |
| 5,121,802 | A | 6/1992 | Rajala et al. | |
| 5,174,387 | A * | 12/1992 | Arndt et al. | 173/1 |
| 5,416,697 | A * | 5/1995 | Goodman | 702/9 |
| 5,458,207 | A | 10/1995 | Mattero | |
| 5,778,990 | A | 7/1998 | Niemi | |
| 6,363,780 | B1 * | 4/2002 | Rey-Fabret et al. | 73/152.45 |

FOREIGN PATENT DOCUMENTS

| | | |
|---|---|---|
| EP | 0 112 810 A | 7/1984 |
| FI | 69680 B | 11/1985 |
| FI | 88744 B | 3/1993 |

* cited by examiner

*Primary Examiner*—David Bagnell
*Assistant Examiner*—David Stephenson
(74) *Attorney, Agent, or Firm*—Drinker Biddle & Reath LLP

(57) ABSTRACT

The rock drill apparatus (1) comprises a rock drill machine (6) provided with a percussion device (4), a feed device (9) and a tool (7), the tool (7) end comprising a bit (8) for breaking rock. The tool (7) is arranged to transmit impact energy generated by the percussion device (4) as a compression stress wave to the bit. The feed device (9) is arranged to thrust the tool (7) and the bit (8) against the rock to be drilled, whereby on drilling at least part of the compression stress wave generated by the percussion device (4) to the tool (7) reflects from the rock to be drilled back to the tool (7) as tensile stress, and impact energy of the percussion device (4) is adjusted on the basis of the level of tensile stress ($\sigma_v$) reflecting from the rock.

12 Claims, 4 Drawing Sheets

METHOD AND ARRANGEMENT OF CONTROLLING OF PERCUSSIVE DRILLING BASED ON THE STRESS LEVEL DETERMINED FROM THE MEASURED FEED RATE

FIELD OF THE INVENTION

The invention relates to a method in connection with a rock drill apparatus, which rock drill apparatus comprises a rock drill machine provided with a percussion device, a feed device and a tool, the tool end comprising a bit for breaking rock, and the tool being arranged to transmit impact energy generated by the percussion device as a compression stress wave to the bit and the feed device being arranged to thrust the tool and the bit against the rock to be drilled, whereby on drilling at least part of the compression stress wave generated by the percussion device to the tool reflects from the rock to be drilled back to the tool as tensile stress.

The invention further relates to an arrangement in connection with a rock drill apparatus, which rock drill apparatus comprises a rock drill machine provided with a percussion device, a feed device and a tool, the tool end comprising a bit for breaking rock, and the tool being arranged to transmit impact energy generated by the percussion device as a compression stress wave to the bit and the feed device being arranged to thrust the tool and the bit against the rock to be drilled, whereby on drilling at least part of the compression stress wave generated by the percussion device to the tool reflects from the rock to be drilled back to the tool as tensile stress.

BACKGROUND OF THE INVENTION

Rock drill machines are employed for drilling and excavating rock e.g. in underground mines, opencast quarries and on land construction sites. Known rock drilling and excavating methods include cutting, crushing and percussing methods. Percussion methods are most commonly in use in connection with hard rock types. In the percussion method the tool of the drill machine is both rotated and struck. Rock breaks, however, mainly by the effect of an impact. The main function of the rotation is to make sure that buttons or other working parts of the drill bit or bit at the outer end of the tool always hit a new spot in the rock. The rock drill machine generally comprises a hydraulically operated percussion device, whose percussion piston provides the tool with the necessary compression stress waves and a rotating motor that is separate from the percussion device. In the percussion method efficient breaking of rock requires that the bit be against the rock surface at the moment of impact. The impact energy of the percussion device strike produces in the tool a compression stress wave, which is transmitted from the tool to the bit arranged in the tool end and therefrom further to the rock. Generally, in all drilling conditions part of the compression stress wave reflects back to the tool as tensile stress. If the rock is soft and the rock/bit contact is poor the level of tensile stress is high in the wave reflecting from the rock. If drilling is continued into soft rock with excessive impact energy it generally results in worn threaded joints between the drill rods and/or premature fatigue failures of the drilling tool.

In general, the method that is currently used for drilling control, a so-called feed-impact-followup-control method, is not able to prevent drilling into soft rock with excessive impact energy. In the feed-impact-followup-control method the impact pressure is controlled on the basis of the feed of the drilling machine. The interdependence of the impact pressure and the feed pressure in rock drilling is presented in U.S. Pat. No. 5,778,990, for instance. When soft rock is drilled, the feed pressure remains in the set value. Only, if the velocity limit set for the feed of the drilling machine is exceeded, the feed pressure drops and the pressure of the impact along with it. However, in a situation, for instance, where the feed-impact-followup-control method is used for drilling from hard to soft rock, the penetration rate of the drilling rises. In practice, it is impossible to set the velocity limit of the feed to be sufficiently accurate for penetration rate values of different rock types, in order for the velocity limit of the feed-impact-followup-control to restrict the feed pressure in a desired manner. Because the penetration rate of the drilling thus remains below the velocity control limit set for the feed, the feed pressure and consequently the impact pressure remain at the original level, which results in high tensile stress in the tool. Generally speaking, the velocity limit is constant and it is set so high that it will not detect change in rock type, but only drilling into a void.

SUMMARY OF THE INVENTION

An object of the present invention is to provide a novel solution to adjust impact energy of a drilling machine.

The method of the invention is characterized by adjusting impact energy of the percussion device on the basis of the level of tensile stress reflecting from the rock to be drilled to the tool.

The arrangement of the invention is characterized in that impact energy of the percussion device is arranged such that it is adjusted on the basis of the level of tensile stress reflecting from the rock to be drilled to the tool.

The basic idea of the invention is that in a rock drill apparatus comprising a rock drill machine provided with a percussion device, a feed-device and a tool, the tool end comprising a bit for breaking rock, and the tool being arranged to transmit impact energy generated by the percussion device as a compression stress wave to the bit and the feed device being arranged to thrust the tool and the bit against the rock to be drilled, whereby on drilling at least part of the compression stress wave generated by the percussion device to the tool reflects from the rock to be drilled back to the tool as tensile stress, impact energy of the percussion device is adjusted on the basis of the level of the tensile stress reflecting from the rock to be drilled to the tool. According to a first embodiment of the invention the level of the tensile stress reflecting from the rock to the tool is determined on the basis of the interdependence of the drilling penetration rate and the tensile stress level. According to a second embodiment of the invention the interdependence of the drilling penetration rate and the tensile stress level is utilized by setting an impact pressure to be used in the percussion device, setting the highest allowed tensile stress level, to which the tool of the rock drill machine is subjected, determining the highest allowed penetration rate of drilling on the basis of the impact pressure used and the highest allowed tensile stress level, determining the actual penetration rate of drilling, comparing the actual penetration rate of drilling with the highest allowed penetration rate and if the actual penetration rate exceeds the highest allowed penetration rate the operation of the rock drill machine is adjusted such that the impact energy of the percussion device reduces to a level, where the actual penetration rate is at most equal to the highest allowed penetration rate of drilling, whereby the tensile stress level, to which the tool of the rock drill machine is subjected, remains below the set highest allowed tensile stress level.

The invention has an advantage that it is possible to affect the loading of the drilling tool directly in a simple manner and thus to affect the service life of the tool, and that it is possible to adjust the impact energy accurately to suit various rock types. Implementation of the solution only requires measurement of the drilling penetration rate, no other measurements are necessarily needed. Controllability of the drilling improves considerably, because the feed-impact-followup-control method does not react at all if there is no change in the feed pressure. Furthermore, the solution provides information on hardness of the rock at that moment with a given accuracy.

In the following, the present document will also use another parameter, penetration resistance of rock, in addition to rock hardness. In accordance with the definition, the penetration resistance of rock describes the relation between a drill bit or bit penetration and the force resisting it, which mainly depends on hardness of the rock and geometry of the drill bit or bit. Thus, the penetration resistance considers both given characteristics of the drill bit or bit and the hardness of the rock.

BRIEF DESCRIPTION OF THE DRAWINGS

In the following, the invention will be described in greater detail in connection with the attached drawings, wherein

FIG. 1 shows a schematic and highly simplified side view of a rock drill apparatus 1, in which the solution of the invention is utilized. The rock drill apparatus 1 of FIG. 1 comprises a boom 2, at the end of which there is a feed beam 3 which comprises a rock drill machine 6 including a percussion device 4 and a rotating device 5. The rotating device 5 transmits to a tool 7 continuous rotating force by the effect of which a bit 8 connected to the tool 7 changes its position after an impact and with a subsequent impact strikes a new spot in the rock. Conventionally the percussion device 4 comprises a percussion piston that moves by the effect of pressure medium, which percussion piston strikes the rear end of the tool 7 or a shank arranged between the tool 7 and the percussion device 4. Naturally, the structure of the percussion device 4 can also be of some other type. For instance, it is possible to produce the impact pulse with means based on electromagnetism. Percussion devices based on a property of this kind are also regarded as percussion devices herein. The rear end of the tool 7 is connected to the rock drill machine 6 and the outer end or end of the tool 7 comprises a fixed or detachable bit 8 for breaking rock. During drilling, the bit 8 is thrust with a feed device 9 against the rock. The feed device 9 is arranged in the feed beam 3, and the rock drill machine 6 is arranged movably in connection therewith. Typically the bit 8 is a so-called drill bit with bit buttons 8*a*, but other bit structures are also possible. When deep holes are drilled, i.e. in so-called extension rod drilling, drill rods 10*a* to 10*c*, whose number depends on the depth of the hole to be drilled and which constitute the tool 7, are arranged between the bit 8 and the drilling machine 6.

In FIG. 1 the rock drill apparatus 1 is shown considerably smaller than it is in reality as compared with the structure of the rock drill machine 6. For the sake of clarity, the rock drill apparatus 1 of FIG. 1 only comprises one boom 2, feed beam 3, rock drill machine 6 and feed device 9, but it is apparent that the rock drill apparatus is typically provided with a plurality of booms 2 and a feed beam 3 provided with a rock drill machine 6 and a feed device 9 is arranged at the end of each boom 2. Further, it is apparent that generally the rock drill machine 6 also comprises a flushing device for preventing the bit 8 from blocking, but for the sake of clarity the flushing device is omitted in FIG. 1.

The impact energy produced by the percussion device 4 is transmitted as a compression stress wave through the drill rods 10*a* to 10*c* towards the bit 8 at the end of the outermost drill rod 10*c*. When the compression stress wave reaches the bit 8, the bit 8 and the bit buttons 8*a* therein strike the matter to be drilled causing intense compression stress, by the effect of which fractures are formed in the rock to be drilled. If the impact energy of the percussion device 4 is excessive as compared with the rock hardness a problem arises that the tensile stress level in the drilling tool becomes unnecessarily high. If drilling is continued into soft rock with excessive impact energy it generally leads to worn threaded joints between the drill rods 10*a* to 10*c* and/or premature fatigue failures of the drilling tool.

Figure 2:
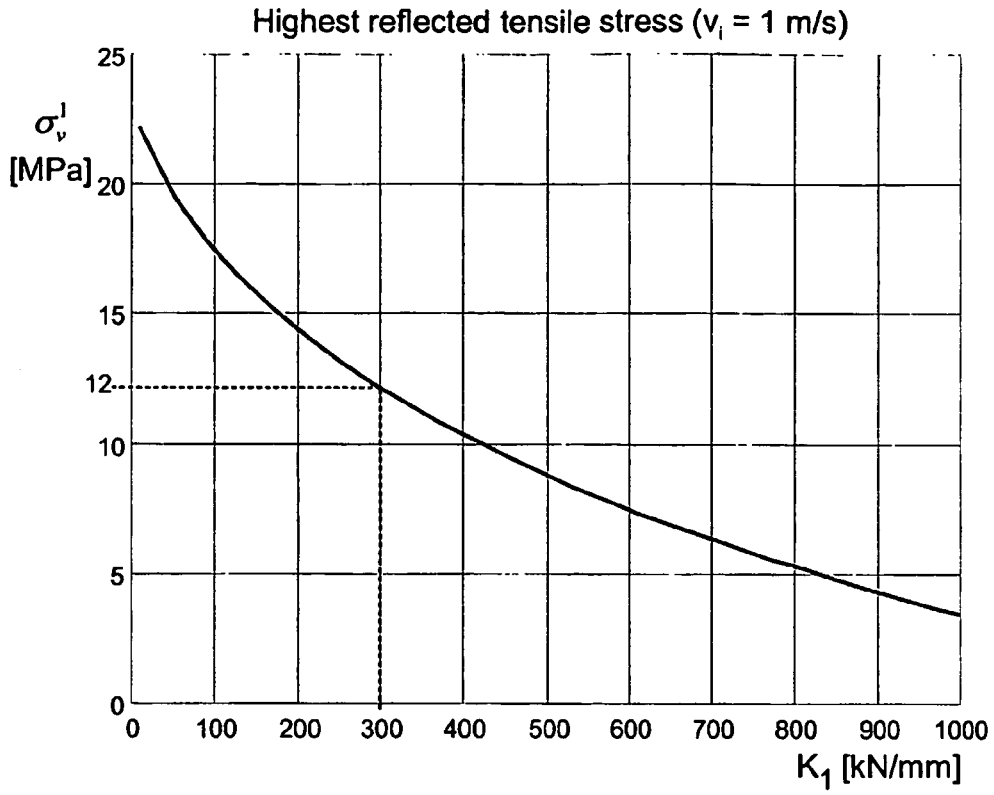
FIG. 2 shows schematically tensile stress produced by a rock drill machine unit strike with different penetration resistances of rock.

The solution of the invention for adjusting the impact energy is based on the fact that it is possible to calculate for each drill machine/tool/bit combination a stress level caused in the tool 7 by a unit impact with different penetration resistances of rock. The unit impact is an impact whose velocity $v_i$ is 1 m/s. FIG. 2 shows schematically unit tensile stress $\sigma_v^1$ caused by the unit impact with different penetration resistances $K_l$ of rock, the penetration resistance varying between $K_l$=10~1000 kN/mm. For one bit type the penetration resistance of rock in soft rock is $K_l$=10 kN/mm, and correspondingly for one bit type the penetration resistance of rock in hard rock is $K_l$=1000 kN/mm. The horizontal axis in FIG. 2 presents the penetration resistance of rock $K_l$ and the vertical axis presents the reflected unit tensile stress $\sigma_v^l$.

Figure 3:
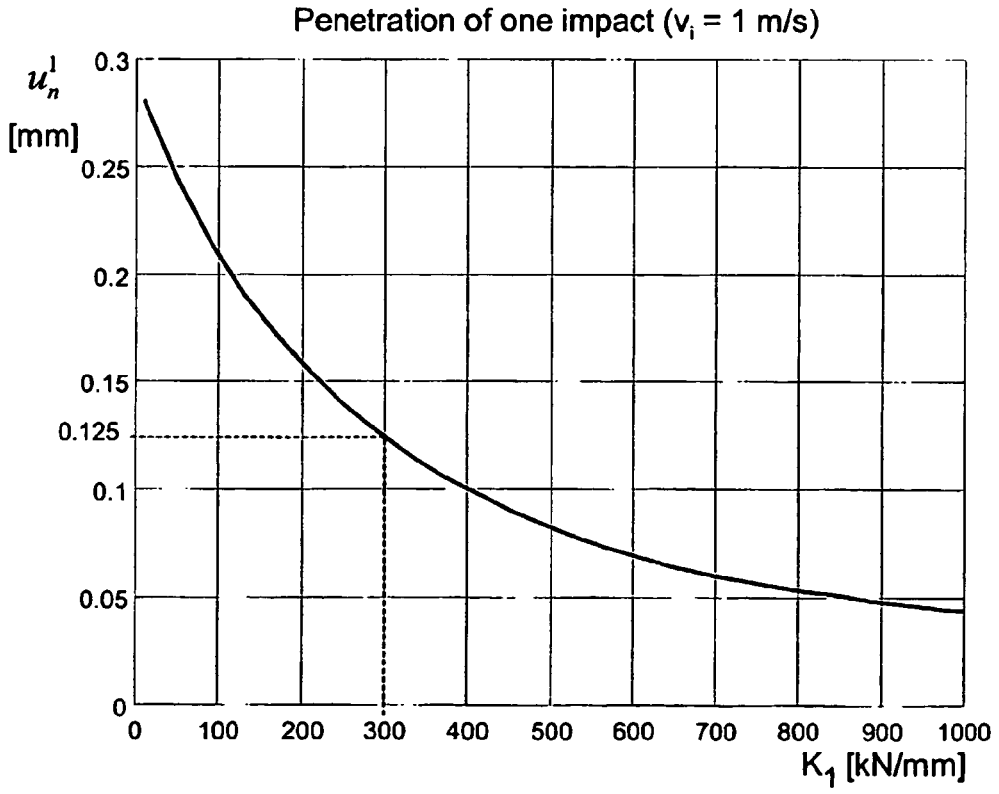
FIG. 3 shows schematically penetration of a bit button produced by a rock drill machine unit strike or unit impact with different penetration resistances of rock.

An impact at velocity $v_l$ causes to the tool a tensile stress level of $$\sigma_v = v_l \sigma_v^l, \tag{1}$$

where $\sigma_v^1$ is the tensile stress corresponding to the unit impact with a given penetration resistance of rock $K_l$ as shown in FIG. 2. Thus, an impact at velocity $v_l$=9.5 m/s into rock, whose penetration resistance is $K_l$=300 kN/mm, causes to the tool tensile stress of $\sigma_v$=9.5*12=114 MPa in accordance with formula (1). Correspondingly, the same impact makes the bit buttons 8*a* of the drill bit 8 to penetrate as follows:

$$u_n = v_l u_n^l, \tag{2}$$

where $u_n^l$ is the penetration of the bit button 8*a*, corresponding to the unit impact, with a given penetration resistance $K_l$, as shown schematically in FIG. 3. For instance, an impact at velocity $v_i$=9.5 m/s into matter whose penetration resistance is $K_l$=300 kN/mm, causes button penetration $u_n$=9.5*0.125=1.19 mm.

Figure 4:
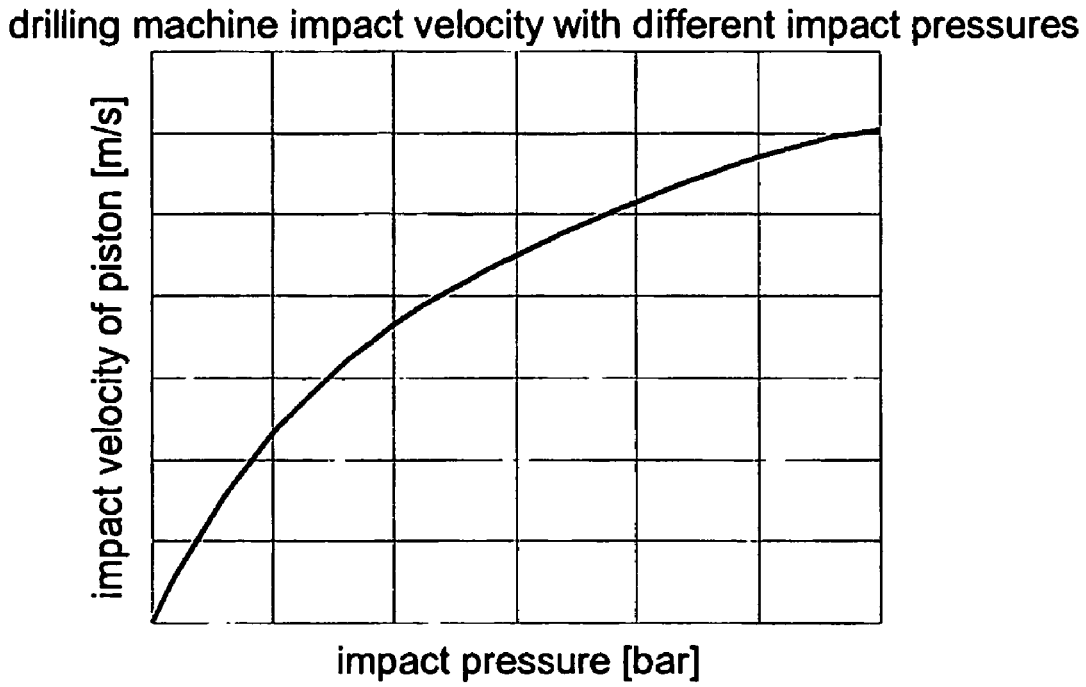
FIG. 4 shows schematically interdependence of impact velocity and impact pressure of a percussion device in a rock drill machine.
Figure 5:
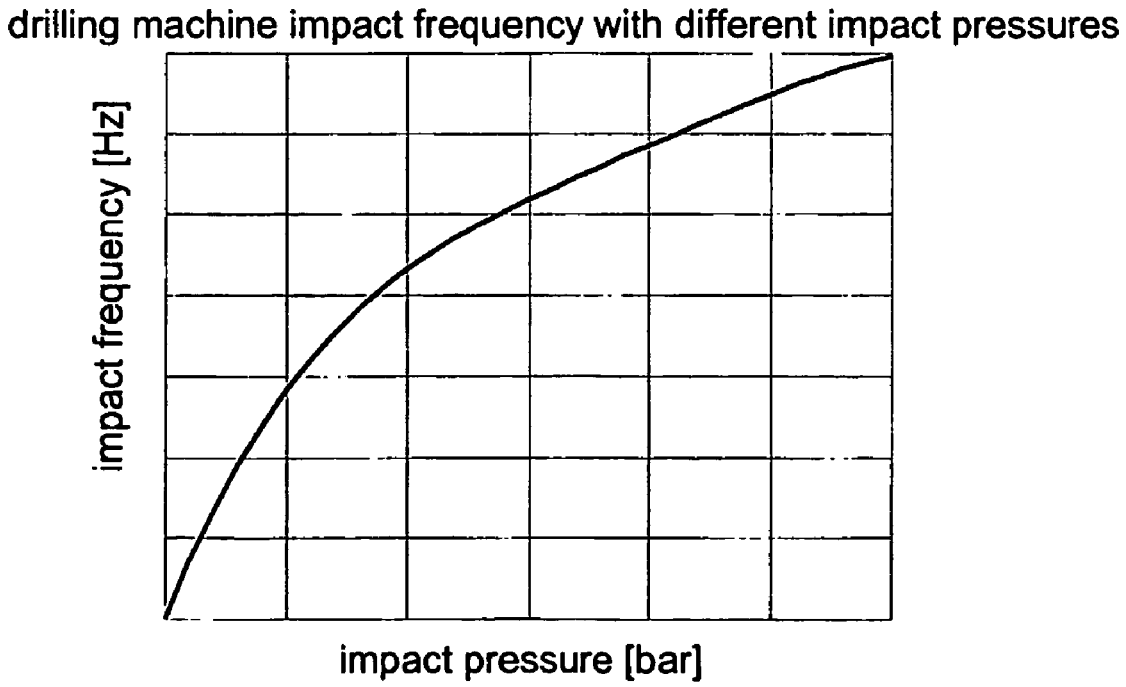
FIG. 5 shows schematically interdependence of impact frequency and impact pressure of a percussion device in a rock drill machine.

Net penetration rate NPR of drilling can be estimated by formula $$NPR=\alpha f(u_n)^{\beta}, \quad (3)$$

where f is impact frequency, α and β are constants which represent the relation between the penetration of the drill bit buttons and the whole drill bit. The constants α and β depend on the diameter of the hole to be drilled and the drill bit geometry, and they can be defined with a sufficient accuracy on the basis of the diameter of the outermost button in the drill bit, the diameter of the drill bit and the number of the outermost buttons. Further, it is possible to determine characteristic curves for each drilling machine, which curves describe how the impact velocity $v_i$ and the impact frequency f depend on the impact pressure. During the drilling, the impact frequency f can be measured e.g. from pressure medium pulsation of the drilling machine. FIG. 4 shows schematically the interdependence of the percussion device impact velocity v; and impact pressure, on the horizontal axis the impact pressure is given in bars and on the vertical axis the impact velocity of the percussion piston of the percussion device 4 is given in metres per second. FIG. 5, in turn, shows schematically the interdependence of the impact frequency f and the impact pressure, on the horizontal axis the impact pressure is given in bars and on the vertical axis the impact frequency of the percussion piston of the percussion device 4 is given in hertz.

DETAILED DESCRIPTION OF THE PREFERRED EMBODIMENTS

An adjustment curve required for impact energy adjustment is obtained in the following manner:

1. set the highest allowed tensile stress level $\sigma_v^{max}$.
2. determine impact velocity $v_i$ and impact frequency f corresponding to each impact pressure.
3. from the impact velocity $v_i$ obtained at point 2, search, by means of formula (1) and the curve of FIG. 2, for the lowest allowed penetration resistance value $K_l^{min}$, which permits the tensile stresses to remain below the highest allowed value $\sigma_v^{max}$.
4. the highest allowed button penetration value $u_n^{max}$ corresponding to the lowest allowed rock penetration resistance value $K_l^{min}$ is obtained by formula (2) and by means of the curve in FIG. 3.
5. the highest allowed penetration rate $NPR^{max}$ is obtained from formula (3), when constants α and β, impact frequency f and the highest allowed button penetration value $u_n^{max}$ are known. In this manner, it is possible to determine for the set tensile stress levels the penetration rate curves describing the highest allowed penetration rate $NPR^{max}$ as a function of impact pressure.
6. if the highest allowed penetration rate $NPR^{max}$ is exceeded during the drilling, the highest allowed tensile stress level $\sigma_v^{max}$ is also exceeded. Therefore impact pressure should be reduced so as to reduce the tensile stresses.

If a drilling machine is used, where the stroke length of the percussion piston of the percussion device 4 can be changed, the impact velocity $v_i$ can be reduced, for instance, by adjusting the stroke length, whereby the impact frequency f increases correspondingly. The impact power then remains constant, but the impact energy reduces to the allowed level. The adjustment curves are then slightly different, because a change in impact frequency f have to be taken into account.

EXAMPLE

Figure 6:
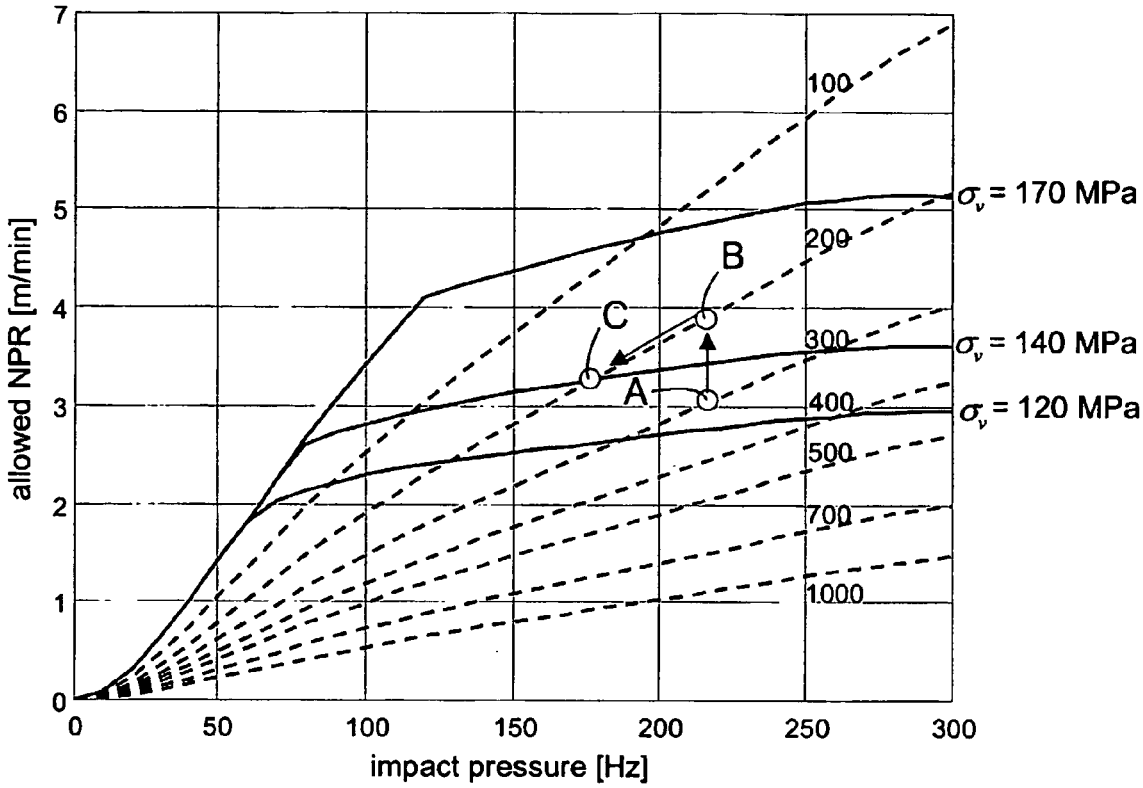
FIG. 6 shows schematically the highest allowed penetration rates of a drilling tool at different tensile stress levels.

FIG. 6 shows schematically, in continuous lines, the highest allowed penetration rates $NPR^{max}$ in one drilling tool at different tensile stress levels $\sigma_v$. The broken lines are auxiliary lines describing the penetration resistance $K_l$ of the rock to be drilled, which help in perceiving the penetration rates NPR with different penetration resistances $K_l$ of the rock to be drilled and different impact pressures. Initially, the drilling takes place at an operating point A, where the impact pressure is 220 bar and the penetration resistance of the rock is about 300 kN/mm. The highest allowed tensile stress level $\sigma_v^{max}$ set by the drilling machine operator is 140 MPa. The drilling penetration rate at the operating point A is 3.1 m/min, so the penetration rate is lower than the highest allowed penetration rate $NPR^{max}$=3.5 m/min corresponding to said impact pressure. As the drilling proceeds, the rock suddenly becomes softer to the penetration resistance value $K_l$=200 kN/mm, which refers to the operating point B of FIG. 6, where the penetration rate is 3.9 m/min, i.e. the penetration rate is higher than what is allowed for said impact pressure. The adjustment solution responds to this by dropping the impact pressure until the operating point C is attained, where the impact pressure is 175 bar and the penetration rate is 3.3 m/min, which is the highest penetration rate allowed for said impact pressure in said hardness of the matter to be drilled.

The solution of the invention permits that it is possible to affect the loading of the drilling tool directly in a simple manner and thus to affect the service life of the tool. It is possible to adjust the impact energy accurately to suit various rock types. Implementation of the solution only requires the measurement of the drilling penetration rate, no other measurements are necessarily needed. The solution improves the controllability of the drilling considerably, because the feed-impact-followup-control method does not react at all if there is no change in the feed pressure. Furthermore, the solution provides information on hardness of the rock to be drilled at that moment with a given accuracy. Further, if the drilling machine is provided with adjustable stroke length, it is possible to adjust impact frequency and impact rate, instead of impact pressure, to be suitable for the rock hardness such that the impact energy reduces but the impact power remains approximately constant.

Figure 1:
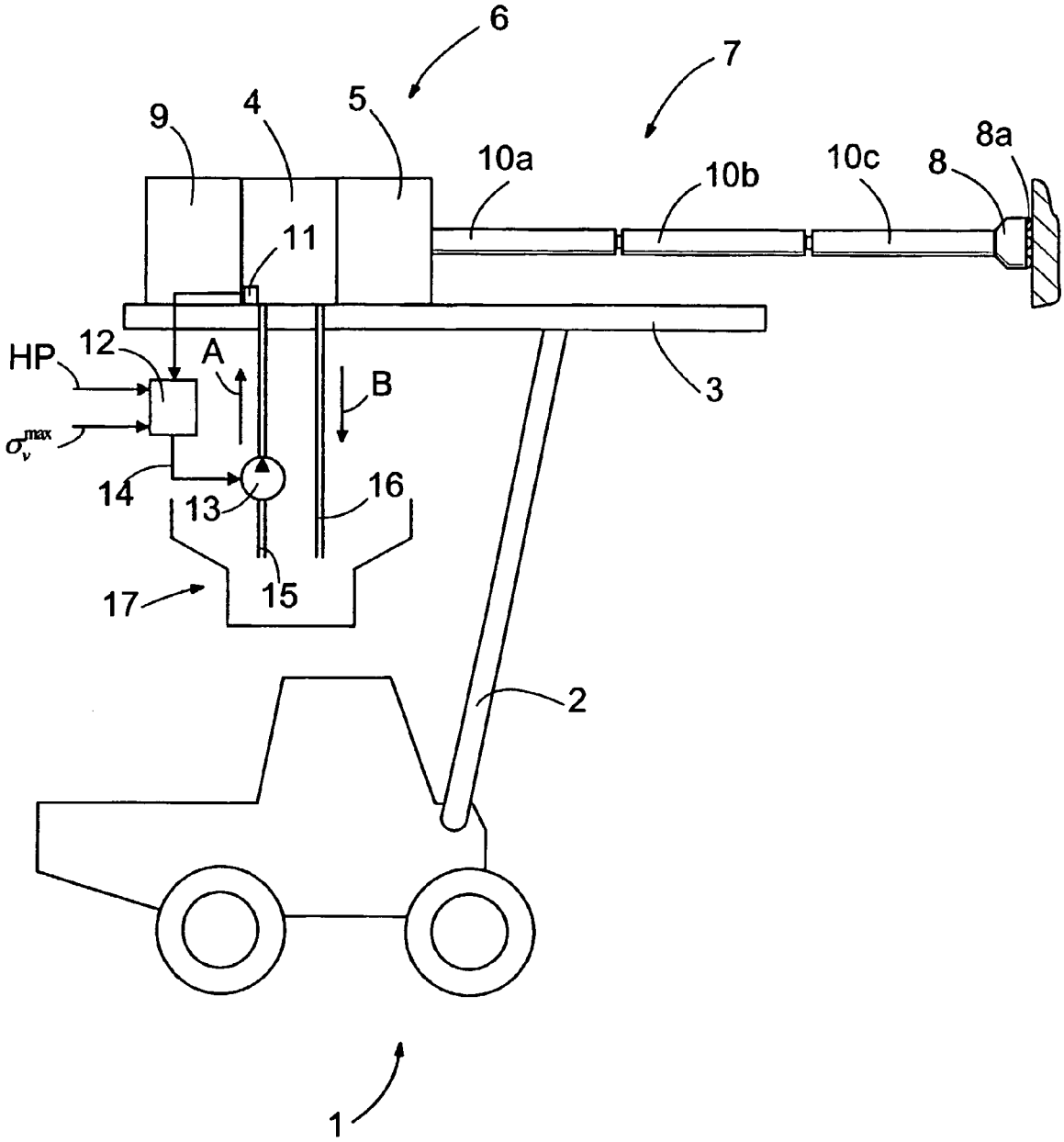
FIG. 1 is a schematic side view of a rock drill apparatus, to which the solution of the invention is applied.

The penetration rate NPR of the drilling machine is measured on the basis of the measurement performed by a measuring means 11 arranged in connection with the drilling machine 6. The measuring means 11 can measure directly propagation velocity of the drilling machine 6 on the feed beam 3, or it can measure the travel of the drilling machine 6 on the feed beam 3, whereby penetration rate of drilling can be determined on the basis of the travel made and the time spent. The measurement message of the measuring means 11 is transmitted to a control unit 12, which is advantageously a micro-processor- or signal-processor-based data processing and control device, which determines a control signal 14 to be applied to a pump 13 on the basis of the measurement signal provided by the measuring means 11 and default values set by the operator. The default values set by the operator include the impact pressure HP of the percussion device 4 when starting the drilling and the highest allowed tensile stress level $\sigma_v^{max}$, during the drilling. On the basis of these two initial values the control unit 12 determines, in the above-described manner, the highest allowed penetration rate $NPR^{max}$, with which the penetration rate measured by the measuring means 11 is compared. If the measured penetration rate exceeds the highest allowed penetration rate $NPR^{max}$ the impact pressure of the percussion device 4 is reduced. The pump 13 pumps pressure fluid through a pressure channel 15 in the direction of arrow A into the percussion device 4 to produce a stroke of the percussion piston. During the reverse stroke of the percussion piston the pressure fluid flows through a return channel 16 into a container 17 in the direction of arrow B. For the sake of clarity, the structure of the percussion device is only shown schematically in FIG. 1, and for instance, one or more control valves that are used for controlling the percussion device in a manner known per se have been omitted in FIG. 1.

The drawings and the relating description are only intended to illustrate the inventive idea. The details of the invention may vary within the scope of the claims. Hence, instead of being hydraulically operated, the drilling machine can also be a pneumatically or electrically operated drilling machine.

The invention claimed is:

1. A method in connection with a rock drill apparatus, which rock drill apparatus comprises a rock drill machine provided with a percussion device, a feed device and a tool, the tool end comprising a bit for breaking rock, and the tool being arranged to transmit impact energy generated by the percussion device as a compression stress wave to the bit and the feed device being arranged to thrust the tool and the bit against the rock to be drilled, whereby on drilling at least part of the compression stress wave generated by the percussion device to the tool reflects from the rock to be drilled back to the tool as tensile stress, the method comprising determining the penetration rate, determining the level of tensile stress reflecting from the rock to be drilled to the tool on the basis of interdependence of drilling penetration rate and the level of the tensile stress and adjusting impact energy of the percussion device on the basis of the level of tensile stress reflecting from the rock to be drilled to the tool.

2. A method as claimed in claim 1, comprising setting an impact pressure to be used in the percussion device, setting the highest allowed tensile stress level, to which the tool of the rock drill machine is subjected, determining the highest allowed penetration rate of drilling on the basis of the impact pressure used and the highest allowed tensile stress level, determining the actual penetration rate of drilling, comparing the actual penetration rate of drilling with the highest allowed penetration rate, and if the actual penetration rate exceeds the highest allowed penetration rate adjusting the operation of the rock drill machine such that the impact energy of the percussion device reduces to a level, where the actual penetration rate is at most equal to the highest allowed penetration rate of drilling, whereby the tensile stress level, to which the tool of the rock drill machine is subjected, remains below the set highest allowed tensile stress level.

3. A method as claimed in claim 2, wherein the actual penetration rate of the drilling is determined by measuring the proceeding rate of the rock drill machine of the feed beam.

4. A method as claimed in claim 1, wherein the actual penetration rate of the drilling is determined by measuring the proceeding rate of the rock drill machine on a feed beam.

5. A method as claimed in claim 1, wherein the impact energy of the percussion device is adjusted by changing the impact pressure of the percussion device.

6. A method as claimed in claim 1, wherein the stroke length of a percussion piston of the percussion device is adjustable and the impact energy of the percussion device is adjusted by changing the stroke length of the percussion piston of the percussion device.

7. An arrangement in connection with a rock drill apparatus, which rock drill apparatus comprises a rock drill machine provided with a percussion device, a feed device and a tool, the tool end comprising a bit for breaking rock, and the tool being arranged to transmit impact energy generated by the percussion device as a compression stress wave to the bit and the feed device being arranged to thrust the tool and the bit against the rock to be drilled, whereby on drilling at least part of the compression stress wave generated by the percussion device to the tool reflects from the rock to be drilled back to the tool as tensile stress, the arrangement comprising a measuring means for determining drilling penetration rate and a control unit that is arranged to determine the level of tensile stress reflecting from the rock to be drilled to the tool on the basis of interdependence of the penetration rate of the drilling and the level of tensile stress and in which arrangement the impact energy of the percussion device is arranged to be adjusted on the basis of the level of tensile stress reflecting from the rock to be drilled to the tool.

8. An arrangement as claimed in claim 7, wherein the control unit comprises means for setting an impact pressure to be used in the percussion device, setting the highest allowed tensile stress level, to which the tool of the rock drill machine is subjected, determining the highest allowed penetration rate of drilling on the basis of the impact pressure used and the highest allowed tensile stress level, determining the actual penetration rate of drilling, comparing the actual penetration rate of drilling with the highest allowed penetration rate, and if the actual penetration rate exceeds the highest allowed penetration rate adjusting the operation of the rock drill machine such that the impact energy of the percussion device reduces to a level, where the actual penetration rate is at most equal to the highest allowed penetration rate of drilling, whereby the tensile stress level, to which the tool of the rock drill machine is subjected, remains below the set highest allowed tensile stress level.

9. An arrangement as claimed in claim 8, comprising a measuring means, which is arranged to determine the actual penetration rate of the drilling by measuring the proceeding rate of the rock drill machine on the feed beam.

10. An arrangement as claimed in claim 7, wherein the actual penetration rate of the drilling is determined by measuring the proceeding rate of the rock drill machine on the a feed beam.

11. An arrangement as claimed in claim 7, wherein the impact energy of the percussion device is adjusted by changing the impact pressure of the percussion device.

12. An arrangement as claimed in claim 7, wherein the stroke length of a percussion piston of the percussion device is adjustable and the impact energy of the percussion device is adjusted by changing the stroke length of the percussion piston of the percussion device.

* * * * *